United States Patent [19]

Teufelberger

[11] 4,403,915

[45] Sep. 13, 1983

[54] EXCESS PRESSURE TURBINE WITH A CONSTANT PRESSURE REGULATION STAGE

[75] Inventor: Arnulf Teufelberger, Gebenstorf, Switzerland

[73] Assignee: BBC Brown, Boveri & Company Limited, Baden, Switzerland

[21] Appl. No.: 216,829

[22] Filed: Dec. 15, 1980

[30] Foreign Application Priority Data

Feb. 1, 1980 [CH] Switzerland ..... 823/80

[51] Int. Cl.[3] ..... F01D 1/04

[52] U.S. Cl. ..... 415/199.5

[58] Field of Search ..... 415/199.5, 181, 19, 415/212 R; 416/223 A

[56] References Cited

U.S. PATENT DOCUMENTS

| | | | |
|---|---|---|---|
| 2,326,072 | 8/1943 | Seippel | 415/199.5 X |
| 2,991,929 | 7/1961 | Stalker | 415/199.5 X |
| 4,274,804 | 6/1981 | Teshima et al. | 415/199.5 X |

FOREIGN PATENT DOCUMENTS

| | | | |
|---|---|---|---|
| 430569 | 2/1948 | Italy | 415/199.5 |
| 817957 | 8/1959 | United Kingdom | 415/199.5 |

*Primary Examiner*—Philip R. Coe

*Attorney, Agent, or Firm*—Werner W. Kleeman

[57] ABSTRACT

An excess steam pressure turbine having a constant pressure regulation stage, wherein for the purpose of reducing the partial impingement losses the first stages of the reaction blading of the turbine are designed with degrees of reaction increasing in stages between 0 and 0.5.

4 Claims, 3 Drawing Figures

EXCESS PRESSURE TURBINE WITH A CONSTANT PRESSURE REGULATION STAGE

BACKGROUND OF THE INVENTION

The present invention relates to a new and improved construction of an excess pressure steam turbine having a constant pressure regulation stage which is arranged forwardly of the reaction blading of the turbine and consists of a regulation impeller and a nozzle scroll or rim of nozzles which can be throttled in sectors.

In order to improve the partial load efficiency there is usually arranged forwardly of the reaction blading of a reaction steam turbine a reaction stage designed as a constant pressure stage. Here the load regulation is accomplished by closing or throttling individual regulation valves operatively associated with a respective sector of the rim or row of nozzles. This partial fluid impingement of the reaction stage results in pronounced irregularities in the flow at the outlet side of the regulation impeller, and thus, results in additional losses in the subsequent stages of the reaction portion or section of the turbine. However, these losses decrease with decreasing degree of reaction of such stages. In the case of small reaction degrees which differ only slightly from null they are appreciably smaller than for the conventionally designed reaction degrees of about 0.5.

The heretofore constructed steam turbines designed for intermittent partial load operation predominantly belonged to the lower and intermediate class of power turbines. In such turbines the diameter of the regulation impeller can be designed appreciably larger than the diameter of the rotor drum forwardly of the first reaction stage without endangering its strength due to centrifugal forces. For this reason there is beneficially obtained between the exit plane of the regulation impeller and the inlet plane of the first reaction stage so much space that the flow following the regulation impeller, with partial fluid impingement, until entry at the reaction portion can be extensively uniformly distributed over the entire cross-section of the flow channel, so that the losses owing to flow irregularities in the first reaction stage can be maintained within narrow limits.

On the other hand, in the case of steam turbines designed for maximum power outputs it is not possible, because of the too large centrifugal forces, to design a possibly provided impeller wheel that much larger in relation to the reaction portion so that the space between the impeller wheel and the first reaction stage is adequate for rendering more uniform the flow over the entire circumference of the flow channel. Such regulation is therefore associated with appreciable losses throughout the partial load range. In the extreme case the impeller wheel only can be designed to have the same diameter as the turbine blading of the first reaction stage, so that during partial impingement of the turbine blading the flow is quite incomplete and the efficiency is appreciably impaired.

This does not play any decisive role as long as it is possible, with acceptable energy costs to permit such turbines to operate continuously with practically constant base load. However, at the present time, owing to the enormously increased energy costs, there now exists to an increasing degree the tendency of operating in a throttled mode turbo-generator units designed for high outputs because of the uneconomical operation during the weak load times. This would be economically feasible with a constant pressure regulation if there were available in the case of smaller turbines sufficient space between the regulation stage and the reaction portion, in order to obtain a homogenous flow forwardly of the reaction portion. Due to the practically constant diameter of the regulation stage and the first reaction stage such would however require a long channel devoid of blading between the regulation stage and the reaction portion or section of the turbine, with correspondingly greater material and machining costs.

SUMMARY OF THE INVENTION

Therefore, with the foregoing in mind it is a primary object of the present invention to provide a new and improved construction of an excess pressure steam turbine having a constant pressure regulation stage wherein such steam turbine can also operate relatively free of losses in the partial load range.

Now in order to implement these and still further objects of the invention, which will become more readily apparent as the description proceeds, the excess pressure turbine of the present development is manifested by the features that the first stages of the reaction blading, following the regulation impeller, are designed so as to have intermediate degrees of reaction increasing in stages, whose value lies between 0 and 0.5.

BRIEF DESCRIPTION OF THE DRAWINGS

This invention will be better understood and objects other than those set forth above, will become apparent when consideration is given to the following detailed description thereof. Such description makes reference to the annexed drawings wherein throughout the various figures of the drawings there have been conveniently used the same reference characters to denote the same or analogous components and wherein.

DETAILED DESCRIPTION OF THE PREFERRED EMBODIMENTS

Figure 1:
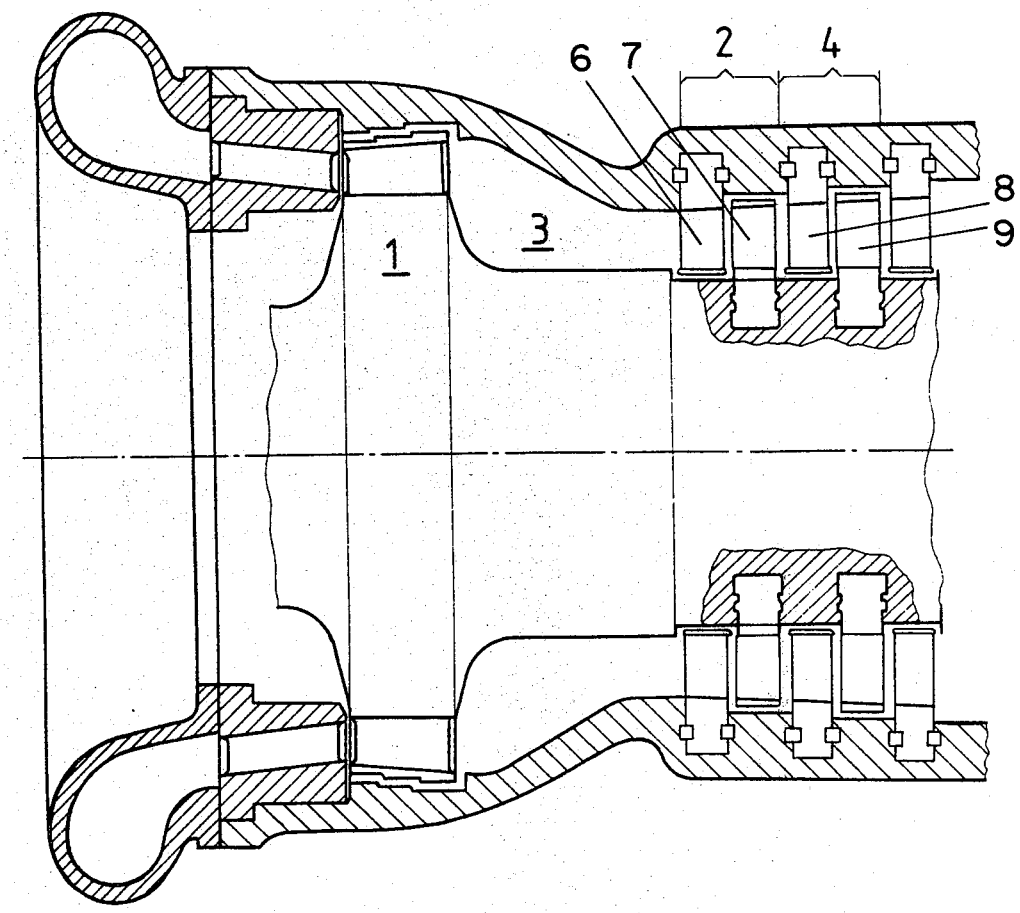
FIG. 1 illustrates a first exemplary embodiment of a steam turbine constructed according to the invention.

Describing now the drawings, with the embodiment of steam turbine illustrated in FIG. 1 there will be seen therein the regulation portion of a high-output steam turbine wherein the diameter of the regulation impeller or wheel 1 can be designed to be greater than the diameter of the first reaction stage 2, but still not so large in size that with a length of the flow channel 3 between the regulation stage and the reaction stage, which flow channel length can be tolerated in terms of the constructional expenditure, the volume of the channel 3 is sufficient for rendering completely uniform the flow over the entire channel circumference.

In order to avoid the thus caused impairment of the efficiency, which arises in the first stages 2, 4 and so forth of the reaction portion or section of the turbine, in the event that such is designed so that starting with the first stage 2 there is realised the conventional degree of reaction of 0.5, it is contemplated according to the invention to design the first stages of the reaction section, starting from a small degree of reaction, so as to increase up to the usual reaction degree of 0.5. In the extreme case, in other words in the presence of pronounced nonuniformity of the flow before the entry into the reaction portion or section of the turbine, the first stage 2 is designed so as to have the degree of reaction null, in other words is a purely constant pressure stage. This measure is essentially comparable to increasing the channel length between the regulation impeller and the first stage 2 designed so as to have a reaction degree $>0$. In the event that the irregularities of the inflow of the fluid medium to the reaction portion is not very pronounced, then the first reaction stage 2 can be designed to have a small degree of reaction, for instance amounting to 0.2, so that the losses are likewise appreciably reduced in relation to a reaction degree of 0.5.

The following stages 4 and so forth of the reaction portion or section of the turbine then have stepped increasing greater reaction degrees up to 0.5. As a practical matter the gradient is preferably limited to two to three stages of the reaction section of the turbine, for instance in the following combinations: 0; 0.2; 0.5 or 0.1; 0.3; 0.5. However, depending upon the prevailing conditions it is also possible to provide for a much finer graduation over more than three stages.

Figure 2:
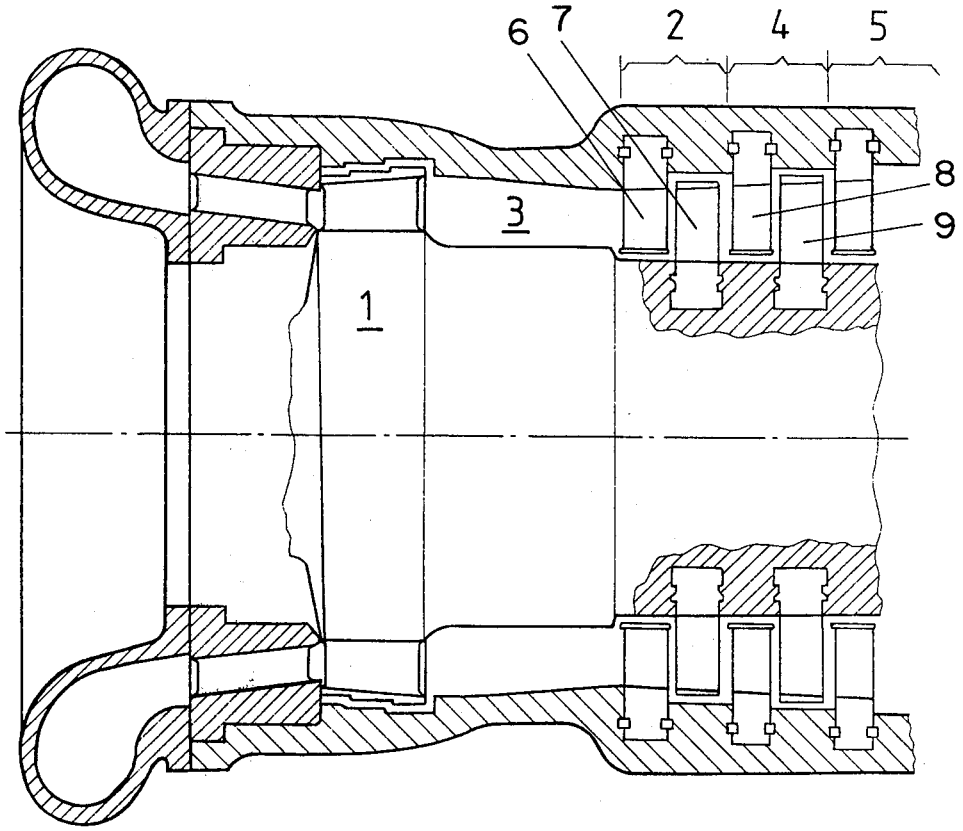
FIG. 2 illustrates a second exemplary embodiment of inventive steam turbine.

This is particularly the case for the turbine which has been illustrated in FIG. 2, wherein the regulation impeller 1, for reasons of strength, is designed only to be approximately equal to the first stage 2 of the regulation portion or section of the turbine. Since here the flow channel has a relatively small volume, the first stage of the reaction portion is preferably designed as a purely constant pressure stage and the following stepwise increase of the reaction degree to 0.5 can be divided over a number of, such as about three to four, of the following reaction stages 4, 5 and so forth.

Figure 3:
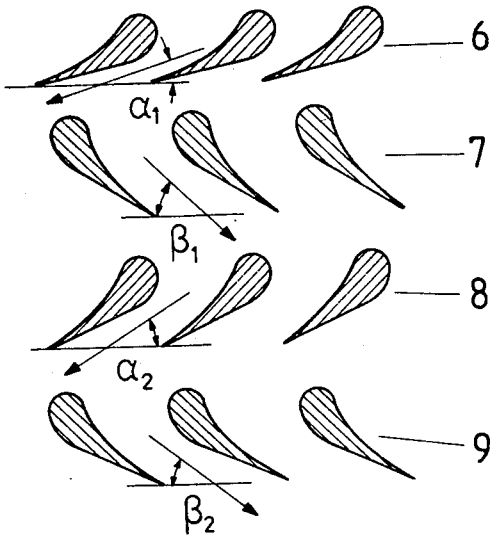
FIG. 3 schematically illustrates the blading layout of the first two reaction stages of such turbine.

The variation of the reaction degree can be accomplished according to two techniques or with a combination thereof:

In conventional manner by appropriately increasing the flow channel cross-section of the rotor blades or, as shown in FIG. 3, by stepwise increasing the exit angle $\alpha$ of the rows of guide blades or nozzles 6, 8 and so forth and a stepwise or stagewise reduction of the exit angle $\beta$ of the rows of moving blades or buckets 7, 9 and so forth, in other words $\alpha_1<\alpha_2<\alpha_3$ and so forth and $\beta_1>\beta_2>\beta_3$ and so forth, and finally, also by a combination of such measures.

At this point it is to be remarked that under the above-mentioned term "reaction degrees" there is to be understood the values at the central portion of the buckets or rotor blade channels.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. In an excess pressure steam turbine containing a constant pressure regulation stage which is arranged forwardly of the reaction blading of the turbine and contains a regulation impeller and a rim of nozzles which throttles in sectors, the improvement which comprises:

first stages following the impeller of the reaction blading, following the impellar wheel being structured so as to have stepwise increasing intermediate degrees of reaction, the value of which is between 0 and 0.5.

2. The improvement as defined in claim 1, wherein: a reaction portion of blading channels is structured in the flow direction so as to have continuously increasing height in order to obtain graduated degrees of reaction of the first stages.

3. The improvement as defined in claim 1, wherein:

said first stages comprise guide bucket channels structured such that an exit angle of guide buckets of a row of guide buckets is greater than an exit angle of guide buckets of a preceding row of guide buckets, and the cross-section of the guide bucket channels is structured such that an exit angle of rotor blades of a row of rotor blades is smaller than an exit angle of rotor blades of a preceding row of rotor blades, in order to thus obtain graduated degrees of reaction of the first stages.

4. The improvement as defined in claim 3, wherein:

blading channels of the first stage of the reaction portion of the turbine possess a height which continuously increases in the flow direction of the fluid medium.

* * * * *